US010792829B2

(12) United States Patent
Sanz Ananos et al.

(10) Patent No.: US 10,792,829 B2
(45) Date of Patent: Oct. 6, 2020

(54) CUTTING MODULES

(71) Applicant: Hewlett-Packard Development Company, L.P., Houston, TX (US)

(72) Inventors: Isabel Sanz Ananos, Sant Cugat del Valles (ES); Martin Urrutia Nebreda, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 7 days.

(21) Appl. No.: 16/073,385

(22) PCT Filed: Apr. 26, 2016

(86) PCT No.: PCT/US2016/029380
§ 371 (c)(1),
(2) Date: Jul. 27, 2018

(87) PCT Pub. No.: WO2017/188937
PCT Pub. Date: Nov. 2, 2017

(65) Prior Publication Data

US 2019/0061191 A1 Feb. 28, 2019

(51) Int. Cl.

| | |
|---|---|
| ***B26D 1/24*** | (2006.01) |
| ***B26D 1/14*** | (2006.01) |
| ***B26D 1/18*** | (2006.01) |
| ***B41J 11/66*** | (2006.01) |
| ***B41J 11/68*** | (2006.01) |
| ***B41J 11/70*** | (2006.01) |

(52) U.S. Cl.
CPC ..... *B26D 1/14* (2013.01); *B26D 1/185* (2013.01); *B26D 1/245* (2013.01); *B41J 11/66* (2013.01); *B41J 11/68* (2013.01); *B41J 11/70* (2013.01)

(58) Field of Classification Search
CPC ..... B26D 1/14; B26D 1/245
See application file for complete search history.

(56) References Cited

U.S. PATENT DOCUMENTS

| | | | | |
|---|---|---|---|---|
| 2,538,972 A * | 1/1951 | Magnani | B23D 45/20 83/24 |
| 3,319,500 A * | 5/1967 | Siegenthaler | B26D 1/04 83/353 |
| 4,077,291 A * | 3/1978 | Obenshain | B26D 7/2635 83/499 |
| 4,544,293 A | 10/1985 | Cranston et al. | |
| 5,482,389 A | 1/1996 | Bickoff et al. | |

(Continued)

FOREIGN PATENT DOCUMENTS

| | | |
|---|---|---|
| CN | 100589986 | 2/2010 |
| CN | 102905863 | 1/2013 |

(Continued)

*Primary Examiner* — Jennifer B Swinney
(74) *Attorney, Agent, or Firm* — HP Inc. Patent Department

(57) ABSTRACT

In An example cutting module comprises a housing to engage the cutting module with a drive shaft, a cutter engaged with the housing, and a drive system engaged with the housing. The cutting module movable along the drive shaft laterally to a media path, the cutter cuts media along the media path, and the drive system may lock when the drive shaft rotates in a second drive direction such that the cutting module moves with the drive shaft.

16 Claims, 4 Drawing Sheets

(56) References Cited

U.S. PATENT DOCUMENTS

| | | | | |
|---|---|---|---|---|
| 5,761,976 | A * | 6/1998 | Bailey | B26D 1/02 82/100 |
| 5,882,128 | A | 3/1999 | Hinojosa et al. | |
| 5,911,530 | A | 6/1999 | Hinojosa et al. | |
| 5,971,640 | A * | 10/1999 | Brewington | B41J 11/70 400/621 |
| 6,182,550 | B1 * | 2/2001 | Brewington | B41J 11/66 100/288 |
| 7,275,883 | B2 | 10/2007 | Harris et al. | |
| 9,032,850 | B2 | 5/2015 | Chiba et al. | |
| 2004/0175222 | A1 | 9/2004 | Harris et al. | |
| 2013/0118330 | A1 | 5/2013 | Sago et al. | |
| 2013/0126659 | A1 * | 5/2013 | Nakada | B65H 23/182 242/420.4 |
| 2013/0221596 | A1 * | 8/2013 | Watanabe | B26D 7/015 270/1.01 |
| 2017/0225493 | A1 * | 8/2017 | Barco Oria | B26D 1/085 |

FOREIGN PATENT DOCUMENTS

| | | |
|---|---|---|
| CN | 204686940 | 10/2015 |
| JP | 63102608 | 5/1988 |
| JP | 06286261 A | 10/1994 |
| JP | 09295296 | 11/1997 |
| JP | 09300278 | 11/1997 |
| JP | 2007021642 | 2/2007 |
| JP | 2015196027 | 11/2015 |
| WO | WO-2011-146272 | 11/2011 |

* cited by examiner

CUTTING MODULES

BACKGROUND

Imaging systems may print, scan, copy, or perform other actions or operations with media. Further, imaging systems may include feeding or picking systems to load the media and deliver or drive the media through the imaging system for performing operations on or with the media. The imaging systems may scan the media for markings or patterns, deposit printing fluid, such as ink or another printing substance, on the media, and/or may produce duplicates of the media, including markings or patterns thereon, in addition to other functions.

DETAILED DESCRIPTION

Figure 1A:
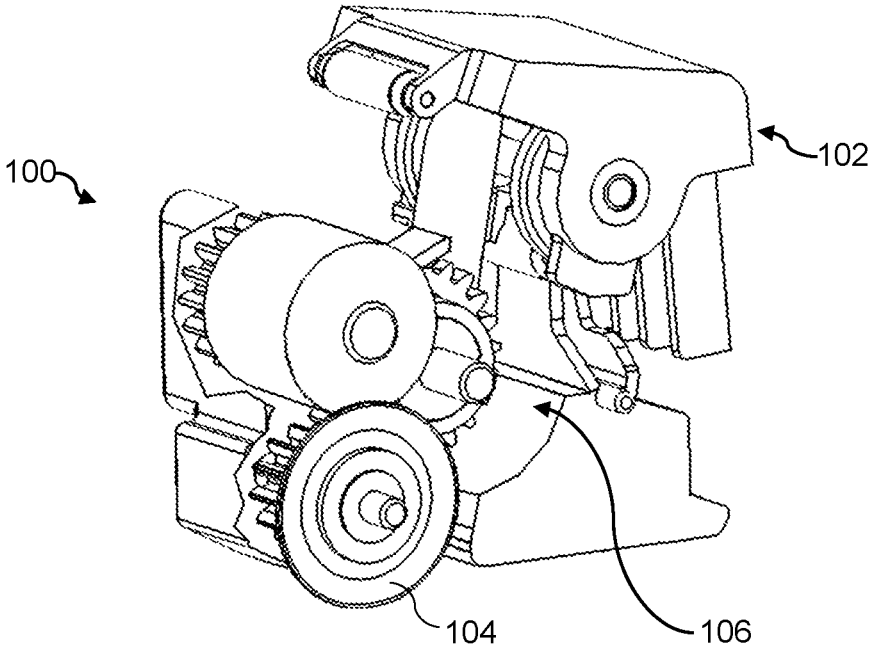
FIG. 1A is a perspective view of an example cutting module.

Imaging systems may include scanning systems, copying systems, printing or plotting systems, or other systems that perform actions or operations on or with media, sometimes referred to as print media. Imaging systems may deposit printing fluid, such as ink, or another printing substance, on media. The imaging system may deposit printing substance on media that is fed through the imaging system from a roll of media. In other situations, the media may be picked from a stack or ream of media for use in the imaging system, or media may be fed into the imaging system one sheet at a time. In some situations, the media may be three-dimensional (3D) print powder of a 3D printer, to be deposited on a print target or bed. In some situations, the media may be of a different size than the area to be printed, scanned, or copied in the imaging device. In such a situation, it may be desirable to cut or trim the media before or after the imaging system has performed the desired action upon the media. In some situations, it may be desirable to cut or trim the media to an appropriate size after the imaging device has deposited printing substance on the media.

In some situations, media may be pre-cut before being loaded into the imaging device, or the media may be removed from the imaging device to be cut or trimmed to an appropriate size during a finishing operation or secondary operation after media undergoes an operation within the imaging device. In some situations, the media may be manually trimmed or cut down to an appropriate size either before loading, or after removal from the imaging device. Such an operation or process can be labor-intensive, time-intensive, and/or expensive. Further, in some situations, the media may be removed from the imaging device and loaded into another device in order for the other device to cut or trim the media to an appropriate size. This type of finishing process or operation, utilizing a separate machine or device to cut the media, can also be labor-intensive, time-intensive, and/or expensive.

It may be desirable, in some situations, to cut media to an appropriate size in the imaging device, so as to avoid a finishing cutting operation, or so as to avoid pre-cutting the media before the media is loaded into the imaging device. It may also be desirable to have the imaging device automatically trim or cut the media within the imaging device to an appropriate size, for example, a size appropriate for the area of the media that has been through an imaging operation, after the operation has been completed. In some situations, it may also be desirable to be able to either cut media, or to avoid cutting media after an imaging operation. In such a situation, the ability to stow the mechanism that is used for cutting media out of the media path may be desirable.

Implementations of the present disclosure provide a cutting module or device, or a cutting system that may cut media within an imaging device. This may avoid pre-cutting the media prior to being loaded into the imaging device, and may also avoid cutting the media, either manually or with another device, after removal from the imaging device, in a finishing operation. Implementations of the present disclosure, being integrated with the imaging device, may avoid additional time and labor costs associated with cutting or trimming media to an appropriate size, or using a separate device to do so. In some implementations, an example cutting module, cutting device, or cutting system, may be disposed within a media path of an imaging device such that the cutting module may cut media to an appropriate size after the imaging device performs a desired action on the media. In further implementations, the cutting module, device, or system, may be able to stow out of, or be removed from, the media path so as to avoid cutting media within the media path.

Figure 1B:
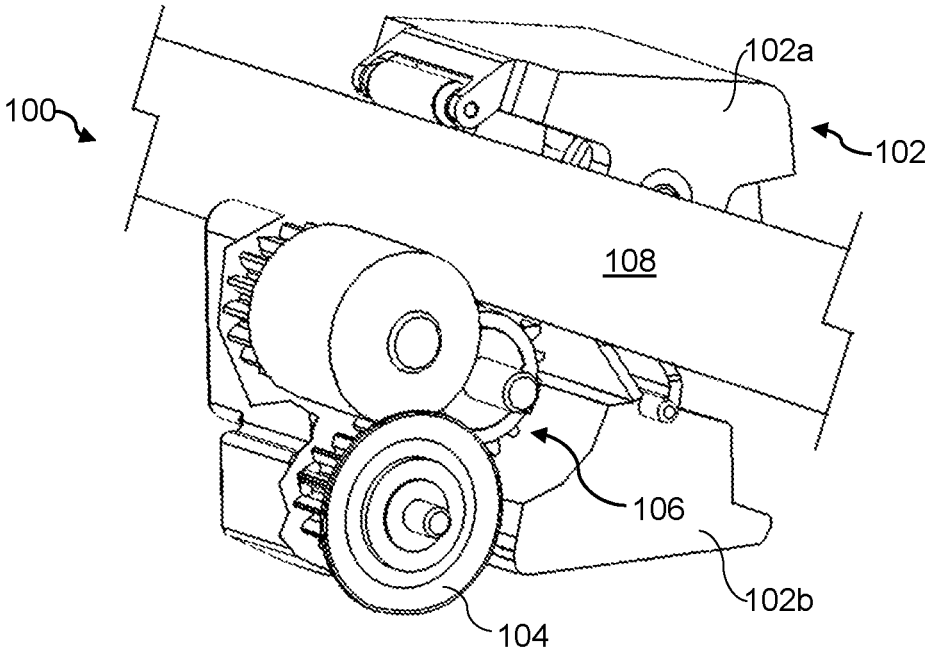
FIG. 1B is a perspective view of an example cutting module.

Referring now to FIG. 1A, a perspective view of an example cutting module 100 is illustrated. The example cutting module may include a housing 102, a cutter 104, and a drive system 106, in some implementations. In further implementations, the housing 102 may be a rigid or semi-rigid frame or other structure to partially or wholly enclose and/or support some or all of the components of the cutting module 100. Referring additionally to FIG. 1B, a perspective view of an example cutting module 100 is illustrated, wherein the cutting module 100, through the housing 102, is engaged with a support shaft, feed shaft, or a drive shaft 108. The drive shaft 108, in some implementations, may be a part of an imaging device or another device. In further implementations, the drive shaft 108 may be considered to be part of the cutting module 100, or a cutting system. In some implementations, the housing 102 may include components that may engage with the drive shaft 108, and enable the drive shaft to rotate relative to the cutting module 100. Such components may include rollers, wheels, bearings, or other components to support and enable rotation of the drive shaft. In some implementations, the drive shaft 108 may engage with the housing 102 or cutting module 100 through three points of contact, which may be rotatable, such that the drive shaft 108 can fully support the cutting module 100, and still rotate relative to the cutting module 100. In further implementations, the housing 102 may include a first portion 102*a* and a second portion 102*b*. The first portion 102*a* may be hingeably, pivotably, or otherwise movably engaged with the second portion such that the first portion may rotate or pivot relative to the second portion. Further, the housing 102 may include a bias member, such as a spring, for example, disposed between the first and second portions 102*a* and

102*b*, respectively, such that the bias member exerts a force against a movement between the two portions. Such a movable relationship or engagement may enable the housing to securely clip on to or hang from the drive shaft 108. Further, the movable relationship between the first and second portions 102*a* and 102*b*, respectively, may enable the housing, and thus the cutting module 100, to be removable or replaceable from the drive shaft 108. Additionally, the housing 102 may engage with the drive shaft 108 such that the cutting module 100 is movable or adjustable along, along the length of, or along a longitudinal axis of, the drive shaft 108.

The cutter 104 may be a component that is structured to cut media. Such media may include paper, cardstock, cardboard, latex, vinyl, or other media suitable for use in an imaging system. In some implementations, the cutter 104 may be disposed partially or wholly within the housing, or supported thereby, or mounted thereon. In further implementations, the cutter 104 may have a suitably sharp cutting edge, or knife edge with which the cutter 104 may cut media. In some implementations, the cutter 104 may be a round, or rotary cutter, wherein the cutter 104 is to cut media by having a sharp edge rotate with media moving past the cutting module 100. In other implementations, the cutter 104 may have a straight cutting edge that may cut media when the media is moved against and past the straight cutting edge, in a similar fashion to a knife blade.

The drive system 106 may be a component, series or assembly of components, or system capable of driving or actuating the cutter 104 such that the cutter 104 cuts media. The cutter 104, therefore, may engage with the drive shaft 108 through the drive system 106. The drive system 106 may include drive wheels, cogs, teeth, pulleys, belts, or other suitable mechanical or electro-mechanical components. In some implementations, the drive system 106 may be a transmission, or may include a transmission for transmitting rotational motion from a rotating component to the cutter 104, such that the cutter 104 rotates to cut media. In further implementations, the drive system may include a motor, or may be engaged with a motor, or another electrical component capable of driving the cutter 104.

Figure 1C:
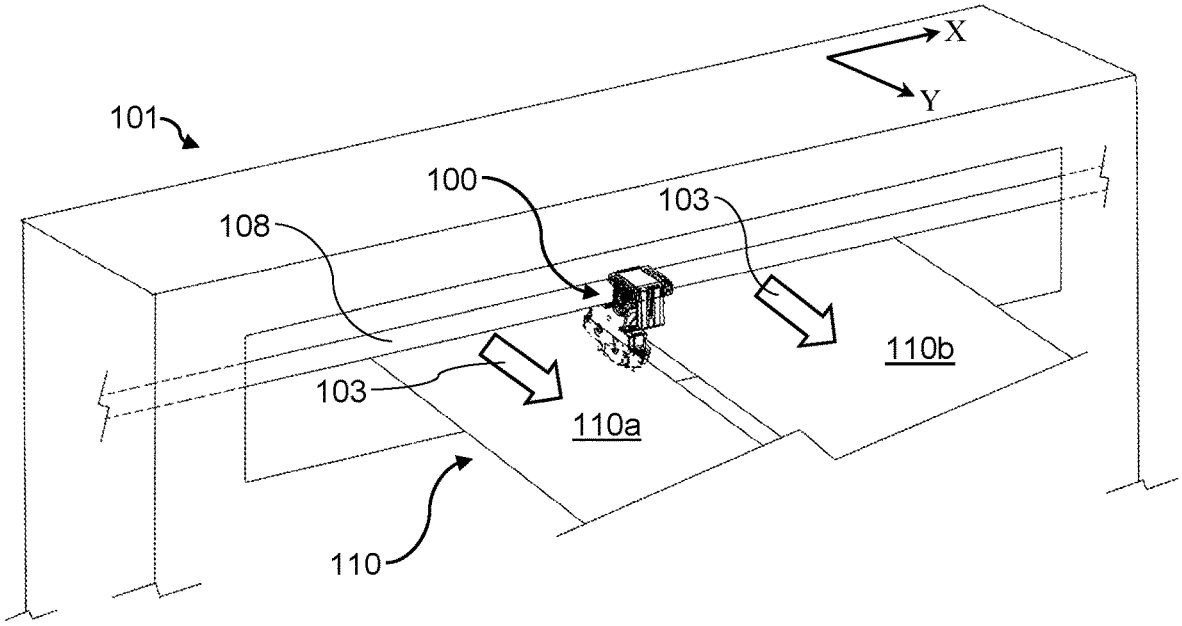
FIG. 1C is a perspective view of an example imaging device including an example cutting module.

Referring now to FIG. 1C, a perspective view of an example imaging device 101 including an example cutting module 100, is illustrated, wherein the example cutting module 100 is engaged with a drive shaft 108. The example imaging device 101 may be a printer, plotter, 3D printer, scanner, copier, press, labeler, or other device or system that may perform an action or operation upon or with media, or print media. In some implementations, the imaging device 101 may receive media from a roll. In other implementations, the imaging device may receive media from a stack or ream, or receive one individual piece of media at a time. In some implementations, the imaging device 101 may pick media 110, drive media 110, or deliver media 110 through a media path of the imaging device 101 such that the imaging device 101 performs an operation on the media, and may then output the media 110 through the media path to exit the imaging device, and be retrieved by a user. In the example illustrated in FIG. 1C, the media path may be represented by arrows 103, aligned with a Y-direction.

As described above, the cutting module 100 may be engaged with the drive shaft 108. In some implementations, the cutting module 100 may be installed by a user of the imaging device 101. In further implementations, the cutting module 100 may be installed by a user clipping the cutting module 100 onto, or hanging the cutting module 100 from the drive shaft 108. The drive shaft 108, in some implementations, may extend into, or extend across the media path 103 so as to movably or adjustably dispose the cutting module 100 in the media path 103. In some implementations, the drive shaft 108 may extend laterally into the media path 103, or in further implementations, extend orthogonally or normally into the media path 103, or substantially along an X-direction. In this context, the term substantially aligned with the X-direction may refer to the disposition of the drive shaft 108 being such so that the cutting module 100 may move along the drive shaft 108 laterally to the media path 103 in the X-direction and be adjustably disposed along an entire width of the media path 103. In other words, the cutting module 100 may be slid or translated along the drive shaft 108 to orient the cutting module 100 anywhere across the width of the media path 103 and, thus, the media 110 therein, in order to cut the media 110 to a desired width. In some implementations, the cutting module 100 may be manually translated or slid, by a user, for example, along the drive shaft 108 to appropriately place the cutting module 100 to cut media to a desired width. In other implementations, another component or device, such as a translator, may move the cutting module 100 along the drive shaft 108. The translator may be a mechanism or device, sometimes controlled by the imaging device, which is capable of moving the cutting module 100 along the width of the media path 103. In some implementations, the translator may include components such as motors, belt or chain drives, gears, pulleys, or other suitable components.

Once positioned appropriately to cut or trim media 110 to a desired width, the cutting module 100 may cut media 110 along the media path 103, sometimes in the Y-direction. In some implementations, the cutting module 100 may cut the media 110 into a first portion 110*a*, and a second portion, 110*b*, prior to the media being output from the imaging device 101. In some implementations, the cutting module 100 may be disposed in the media path 103 downstream from where the imaging device 101 performs an operation on media 110, such as printing, for example. In other implementations, the cutting module 100 may be disposed upstream from where the imaging device 101 performs an operation on media 110, such that the cutting module 100 may cut the media 110 prior to undergoing an imaging device operation, such as printing, for example.

In some implementations, the imaging device 101 may include a second cutting module, not shown. The second cutting module may be similar in structure and/or function to the first cutting module 100, in some implementations. The second cutting module may be adjustably or movably disposed on the drive shaft 108 in addition to the first cutting module 100. The second cutting module may also cut media within the media path, and may also stow out of the media path 103, similar to the first cutting module 100.

Figure 2A:
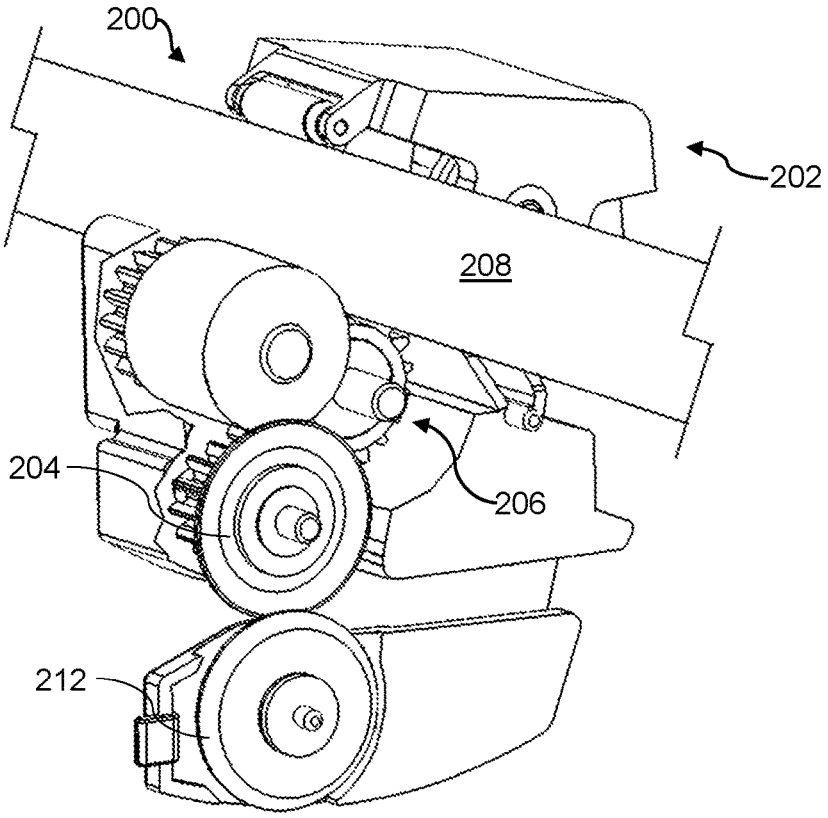
FIG. 2A is a perspective view of an example cutting module.
Figure 2B:
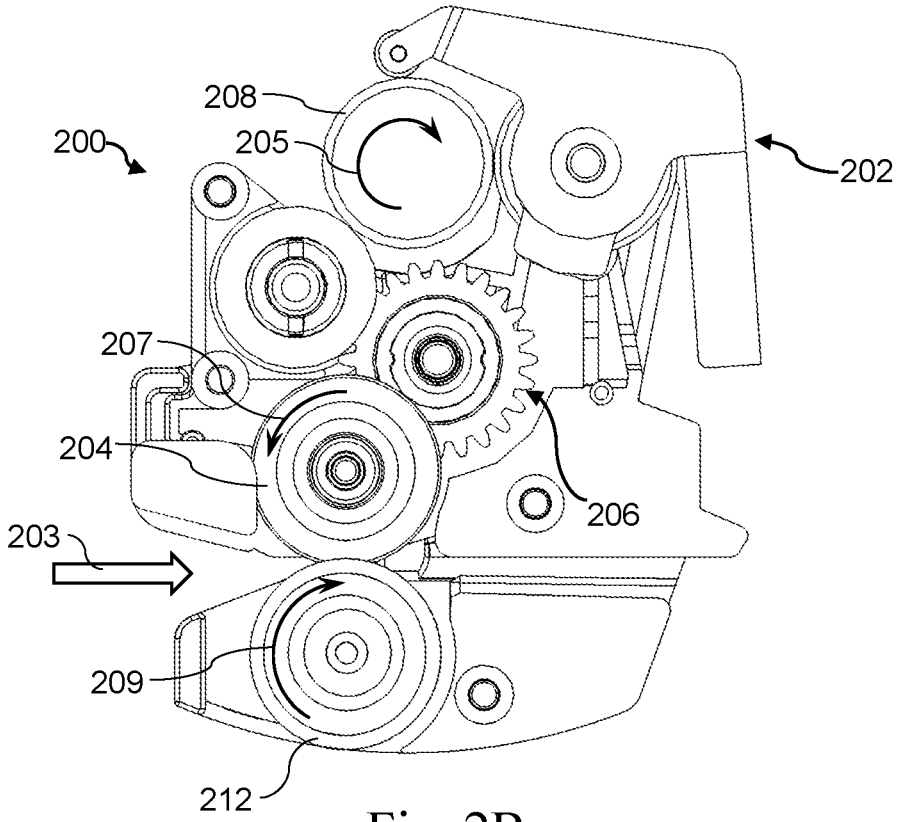
FIG. 2B is a side view of an example cutting module.

Referring now to FIGS. 2A-2B, a perspective view and a side view, respectively, of an example cutting module 200 is illustrated. Example cutting module 200 may be similar to example cutting module 100. Further, the similarly named elements of example cutting module 200 may be similar in function and/or structure to the elements of example cutting module 100, as they are described above. In addition to a housing 202, a cutter or first cutter 204, and a drive system 206, the cutting module 200 may further include a second cutter 212 to cut media travelling through a media path 203. The second cutter 212 may be functionally and structurally similar to the first cutter 204, in some implementations. Therefore, the first and second cutters 204 and 212, respectively, may both be rotary cutters. In other implementations, the second cutter 212 may include a different structure or function than the first cutter 204, yet may still cut media. In some implementations, the first cutter 204 and the second cutter 212 may be oriented relative to one another so as to adequately cut media within the media path when the media is delivered in between the first and second cutters 204 and 212. In some implementations, the first and second cutters 204 and 212 may each have a cutting edge that overlaps with the cutting edge of the other cutter.

The cutting module 200 may include a drive system 206 to drive the first cutter 204 to cut media travelling through the media path 203. The cutting module 200 may be engaged with a drive shaft 208 which may rotate in order to drive or actuate the drive system 206, which, in turn, may drive the first cutter 204 to cut media. In some implementations, the drive system may be a component, or series or a system of components to transmit motion or torque from the drive shaft 208 to the first cutter 204. In further implementations, the drive system 206 may not transmit motion to the cutter 204, but may exist just to allow the drive shaft 208 to rotate in a first drive direction, relative to the cutting module 200, and to prevent the drive shaft 208 from moving relative to the cutting module 200 when rotated in a second drive direction, and to enable the cutting module 200 to rotate with the drive shaft 208 in the second drive direction. In other implementations, the drive system 206 may be a transmission, or may include a transmission for the transfer of motion or torque. The drive system, or a transmission therein, may include cogs, gears, friction wheels, belt or chain drives, or other suitable components to transfer or transmit motion or torque. In further implementations, the drive shaft 208 may rotate or move in a first drive direction 205. The drive system 206 may transmit this motion of the drive shaft 208 to the first cutter 204 such that the first cutter 204 rotates in a cutting direction 207 to cut media travelling through or disposed within the media path 203. Additionally, in some implementations, the first and second cutter 204 and 212 may both be driven by the drive system 206 to cut media. In other implementations, the second cutter 212 may be driven along cutting direction 209, in the same direction as the media path 203, through contact with the media travelling through the media path 203 such that the second cutter 212 cuts the media in the media path 203.

Figure 2C:
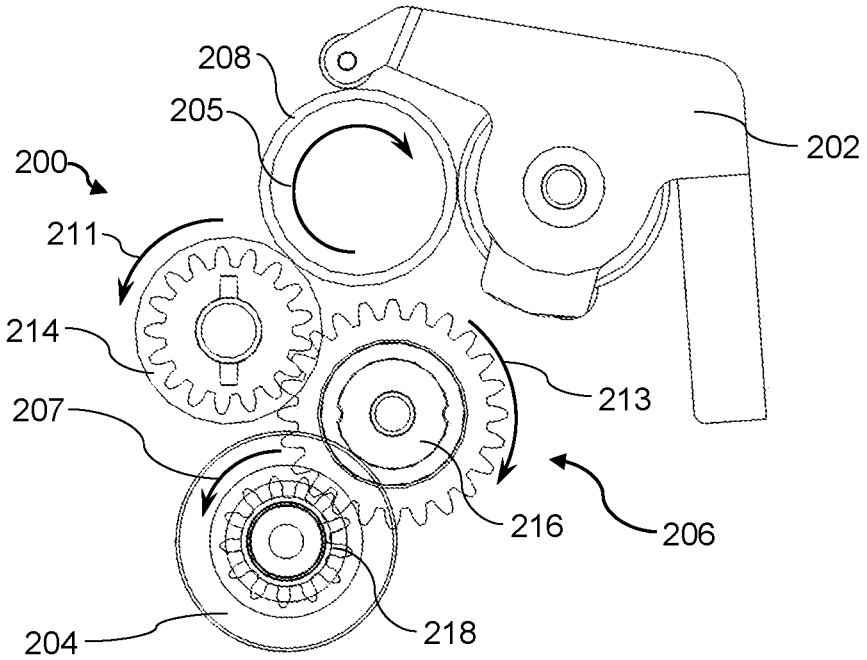
FIG. 2C is a side view of an example cutting module.

Referring additionally to FIG. 2C, a detail view of an example drive system 206 of an example cutting module 200 is illustrated. For clarity, portions of the housing 202, and other portions of the cutting module 200 may have been omitted from FIG. 2C. The drive system 206 may include a drive wheel 214 to engage with the drive shaft 208, and a lock wheel 216 to engage with the drive wheel 214. The drive wheel 214, in some implementations, may be a friction wheel, or, a wheel to engage with the drive shaft 208 through friction. In further implementations, the drive wheel 214 may be constructed of rubber, polymer, or another material with a sufficiently high coefficient of friction to engage and rotate with the drive shaft 208. Regarding the lock wheel 216, in some implementations, the lock wheel 216 may be rotatable in a first direction, or free direction, and may not be rotatable in a second direction, or locked direction, which may be opposite to the free direction. Thus, the lock wheel 216 may be a one-way drive or wheel, having only one direction of movement, and resisting or preventing movement in the opposite direction. In further implementations, the lock wheel 216 may be a one-way bearing.

The drive system 206 may additionally include a cutter drive 218 mated to or engaged with the first cutter 204, and to engage with the lock wheel 216. In some implementations, the cutter drive 218 may engage with the cutter 204 such that the cutter drive 218 may drive the cutter 204 in the cutting direction. In further implementations, the cutter 204 may be able to additionally spin freely in the cutting direction, relative to the cutter drive 218. It should be noted that, although the drive wheel 214, the lock wheel 216, and the cutter drive 218 are illustrated as gears having meshing teeth, each component of the drive system 206 may engage with one another through other methods. Other methods of engagement may include friction wheels or surfaces, belt or chain drives, or other methods of transmitting rotation or torque. In some implementations, the drive shaft 208 may rotate or move in the first drive direction 205, and transmit such motion to the drive wheel 214 to rotate the drive wheel in a direction 211. The drive wheel 214 may then urge the lock wheel 216 in a corresponding direction, causing the lock wheel 216 to rotate in direction 213. Direction 213 may, therefore, be the free direction, or the direction in which the lock wheel 216 is free to rotate, spin, or otherwise move. Thus, the locked direction may be a direction opposite to direction 213, the lock wheel 216 not being movable or rotatable in such a direction. Upon the lock wheel 216 rotating in the free direction, the lock wheel 216 may transmit motion to the cutter drive 218 such that the cutter drive 218 drives the first cutter 204 in the cutting direction 207 to cut media.

Figure 2D:
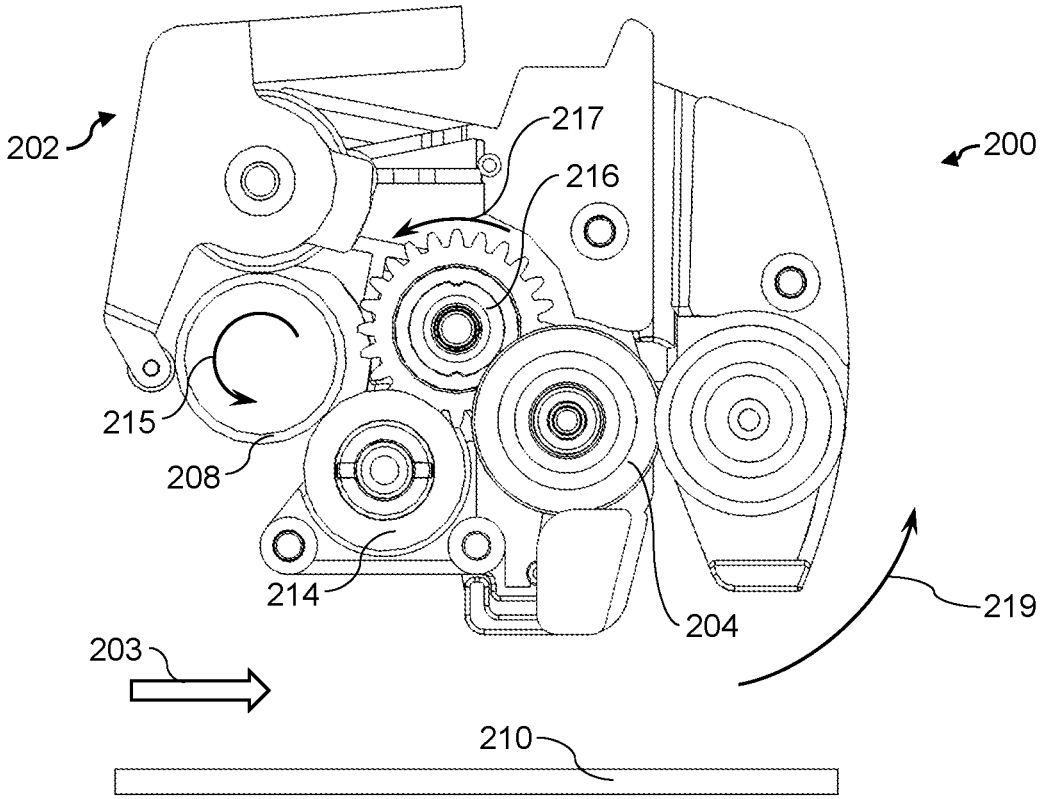
FIG. 2D is a side view of an example cutting module.

Referring now to FIG. 2D, a side view of an example cutting module 200 is illustrated. In some implementations, the drive shaft 208 may rotate or move in a second drive direction 215. In such a situation, the drive shaft 208 may attempt to transmit this motion to the drive wheel 214, and, thus, to the lock wheel 216, urging the lock wheel in a direction 217. Direction 217 may be an opposite direction to the free direction of the lock wheel 216, and, thus, the lock wheel 216 may not be able to move or rotate in direction 217 when urged in such a manner. As such, the lock wheel 216 may also lock the drive wheel 214 such that the drive wheel cannot rotate relative to the cutting module 200. In some implementations, the lock wheel 216 may lock the drive wheel 214, and thus the entire drive system 206, housing 202, and cutting module 200 to the drive shaft 208. The drive shaft 208 may then be exerting motion or torque against the entire cutting module 200, not just the drive wheel 214, in the second drive direction 215. As such, the drive shaft 208 may exert enough torque on the cutting module 200 to rotate, move or pivot the cutting module 200 along direction 219, about the center of rotation of the drive shaft 208. Upon moving along direction 219, the cutting module 200, and the cutter 204 thereof, may move out of the media path 203 such that the cutter 204 no longer obstructs the media path 203 and media 210 may pass through the media path 203 without being cut by the cutting module 200. Additionally, in implementations having a second cutter 212, the second cutter 212 may also be rotated or pivoted out of the media path 203 with the cutting module 200 so as to not cut media 210 travelling through the media path 203.

Therefore, in other words, the drive shaft 208 may rotate in a first drive direction 205 in order to drive the drive system 206, and thus the first and/or second cutters 204 and 212, of the cutting module 200 to cut media 210 travelling in the media path 203. When the drive shaft 208 switches rotation direction and starts to rotate in the second drive direction 215, the drive system 206 may lock, and thus, lock the drive system 206 and the cutting module 200 to the drive shaft 208 such that the drive shaft 208 rotates the cutting module 200 out of the media path 203, and media 210 is no longer cut as it travels through the media path 203.

Figure 3:
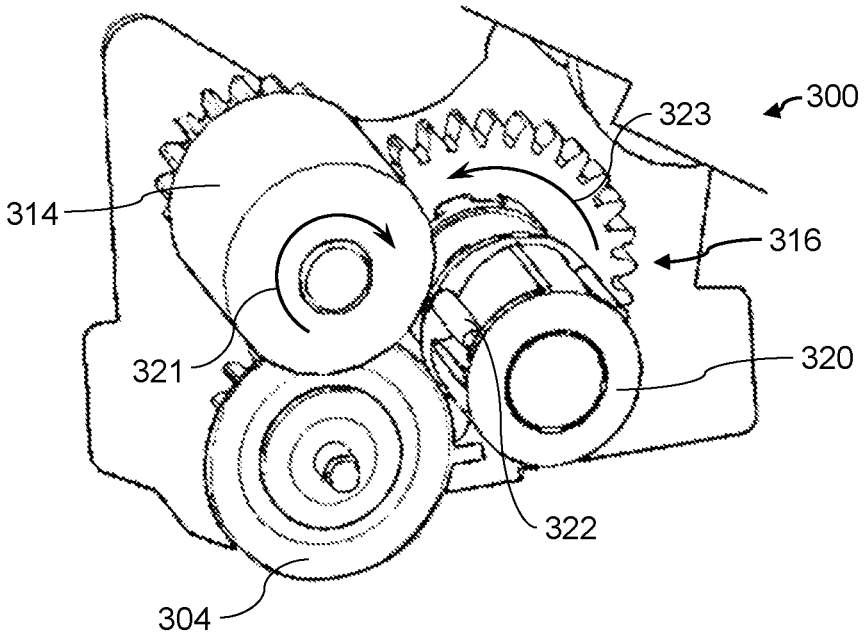
FIG. 3 is a perspective view of an example cutting module.

Referring now to FIG. 3, a partial perspective view of an example cutting module 300, or a drive system thereof, is illustrated. Example cutting module 300 may be similar to above-described example cutting modules. Further, the similarly named elements of example cutting module 300 may be similar in function and/or structure to the elements of the other example cutting modules, as they are described above. Example cutting module 300 may include a drive wheel 314, a lock wheel 316, and a cutter 304. In some implementations, the lock wheel 316 may include a lock pin 322 to engage with a stop wheel 320. The stop wheel 320 may be fixed to the housing or another component of the cutting module 300 such that it does not rotate relative to the cutting module 300, in some implementations. Further, the lock pin 322, or, in some implementations, multiple lock pins 322, may be fixed to the lock wheel 316 such that they rotate or move with the lock wheel 316, relative to the stop wheel 320. The stop wheel 320 may engage with the lock pin 322 or lock pins such that the stop wheel 320 only allows the pins to move in one direction relative to the stop wheel 320. In order to accomplish this, the stop wheel 320 may include stop walls, tabs, or shelves, in some implementations, that the lock pins 322 cannot move past. Therefore, in some implementations, if a drive shaft were to rotate the drive wheel 314 in a drive direction 321, and the drive wheel 314 were to urge the lock wheel 316 in a corresponding direction 323, the stop wheel 320 may include features that may prevent the lock pins 322, and thus the lock wheel 316, from moving relative to the stop wheel 320 in the direction 323. This may, in turn, cause the drive system and/or the cutting module 300 to lock to the drive shaft and to rotate as a whole with the drive shaft.

What is claimed is:

1. A cutting module, comprising:

a housing to engage the cutting module with a drive shaft, the cutting module to be movable along the drive shaft laterally to a media path;

a cutter engaged with the housing, the cutter to cut media along the media path; and a drive system engaged with the housing, the drive system to lock when the drive shaft rotates in a second drive direction such that the cutting module moves with the drive shaft.

2. The cutting module of claim 1, wherein the drive system is to drive the cutter such that the cutter cuts media along the media path when the drive shaft rotates in a first drive direction.

3. The cutting module of claim 2, wherein the drive system comprises a drive wheel to engage with the drive shaft and a lock wheel engaged with the drive wheel, the lock wheel to be rotatable in a free direction, and not rotatable in a locked direction opposite to the free direction.

4. The cutting module of claim 3, wherein the lock wheel is to lock the drive wheel to the drive shaft when the drive shaft rotates in the second drive direction, such that the drive wheel urges the housing to rotate with the drive shaft in the second drive direction.

5. The cutting module of claim 1, wherein the drive system is to lock when the drive shaft rotates in a second drive direction such that the cutting module rotates with the drive shaft out of the media path such that the cutting module does not cut media within the media path.

6. The cutting module of claim 5, wherein the drive system further comprises a cutter drive engaged with the lock wheel, the lock wheel to transmit motion to the cutter drive such that the cutter drive drives the cutter when the lock wheel rotates in the free direction, and to not transmit motion to the cutter drive when the lock wheel is urged in the locked direction.

7. The cutting module of claim 6, wherein the lock wheel is a one-way bearing.

8. The cutting module of claim 1, wherein the drive system is to lock to the dive shaft when the drive shaft rotates in the second drive direction such that the cutting module is moved to a position outside a plane defined by the drive shaft and media path.

9. A cutting system, comprising:

a drive shaft extending into a media path; and a cutting module, comprising:

a housing to engage with the drive shaft to adjustably dispose the cutting module in the media path;

a first cutter, the drive shaft to drive the first cutter to cut media within the media path in a direction along the media path; and a drive system, comprising a transmission to drive the first cutter in a cutting direction when the drive shaft moves in a first drive direction, the drive system to lock the cutting module to the drive shaft when the drive shaft moves in a second drive direction, such that the cutting module moves with the drive shaft and the drive shaft exerts motion or torque against the cutting module to pivot the cutting module about a center of rotation of the drive shaft.

10. The cutting system of claim 9, wherein the drive shaft is to pivot the cutting module out of the media path in the second drive direction such that the cutting module does not cut media within the media path.

11. The cutting system of claim 10, wherein the housing is movable along the length of the drive shaft laterally to the media path to adjustably dispose the cutting module in the media path.

12. The cutting system of claim 11, wherein the cutting module further comprises a second cutter to cut media along the media path when the drive shaft rotates in the first direction.

13. The cutting module of claim 12, wherein the first and second cutters are rotary cutters.

14. An imaging device, comprising:

a media path;

a drive shaft extending across the media path;

a first cutting module adjustably disposed on the drive shaft, comprising:

a housing to engage the cutting module with the drive shaft so the first cutting module is disposed in the media path of the imaging device; and a cutter engaged with the drive shaft through a drive system, the drive shaft to drive the drive system in a first drive direction such that the cutter cuts media moving through the media path within the imaging device, the drive system to lock when the drive shaft when the drive moves in a second drive direction such that continued rotation of the drive shaft in the second drive direction moves the first cutting module out of the media path along the second drive direction.

15. The imaging device of claim 14, further comprising a second cutting module adjustably disposed on the drive shaft to cut media within the media path when the drive shaft moves in the first drive direction.

16. The imaging device of claim 15, wherein the second cutting module comprises a drive system to lock when the drive shaft moves in the second drive direction such that the drive shaft moves the second cutting module out of the media path along the second drive direction.

* * * * *